US006101464A

United States Patent [19]

Serizawa

[11] Patent Number: 6,101,464

[45] Date of Patent: Aug. 8, 2000

[54] CODING AND DECODING SYSTEM FOR SPEECH AND MUSICAL SOUND

[75] Inventor: Masahiro Serizawa, Tokyo, Japan

[73] Assignee: NEC Corporation, Tokyo, Japan

[21] Appl. No.: 09/047,354

[22] Filed: Mar. 24, 1998

[30] Foreign Application Priority Data

Mar. 26, 1997 [JP] Japan ..... 9-072550

[51] Int. Cl.[7] ..... G10L 19/04

[52] U.S. Cl. ..... 704/219; 704/220

[58] Field of Search ..... 704/207, 216, 704/219, 220, 226, 230; 84/616

[56] References Cited

U.S. PATENT DOCUMENTS

| | | | |
|---|---|---|---|
| 4,933,957 | 6/1990 | Bottau et al. | 704/217 |
| 5,313,554 | 5/1994 | Ketchum | 704/219 |
| 5,327,520 | 7/1994 | Chen | 704/219 |
| 5,444,816 | 8/1995 | Adoul et al. | 704/219 |
| 5,450,449 | 9/1995 | Kroon | 704/219 |
| 5,495,555 | 2/1996 | Swaminathan | 704/207 |
| 5,651,091 | 7/1997 | Chen | 704/223 |
| 5,708,756 | 1/1998 | Wang et al. | 704/220 |
| 5,787,390 | 7/1998 | Quinquis et al. | 704/219 |

FOREIGN PATENT DOCUMENTS

782128A1 7/1997 European Pat. Off. .

OTHER PUBLICATIONS

Juin–Hwey Chen, et al., "A Low–Delay CELP Coder for the CCITT 16 kb/s Speech Coding Standard", vol. 10, No. 5, Jun. 1, 1992, pp. 830–849, Institute of Electrical and Electronics Engineers Journal.

Alv Aarskog, et al., "A Long–Term Predictive ADPCM Coder With Short–Term Prediction and Vector Quantization", vol. 1, No. Conf. 16, May 14, 1991, pp. 37–40; Institute of Electrical and Electronics Engineers.

Serizawa, et al., "A 16 KBIT/S Wideband CELP Coder With a High–Order Backward Predictor and Its Fast Coefficient Calculation", Sep. 1997, pp. 107–108, IEEE.

S. Sasaki et al., "Improved CELP Coding for Audio Signal," Proc. Acoustical Society of Japan, 1–4–23, pp. 263–264 (Mar. 1996).

M.R. Schroeder, et al., "Code–Excited Linear Prediction (CELP): High–Quality Speech At very Low Bit Rates", IEEE Proc. ICASSP–85, 1985, pp. 937–940.

J.R. Deller, Jr., et al., "Discreet–Time Processing of Speech Signals", Macmillan Pub., 1993, pp. 290–331.

J–H. Chen, et al., "A Fixed–Point 16 kb/s LD–CELP Algorithm", IEEE ICASSP–91, pp. 21–25.

K. Ozawa, et al., "M–LCELP Speech Coding at 4 kb/s With Multi–Mode and Multi–Codebook", IEICE Trans. Commun., vol. E77–B, No. 9, Sep. 1994, pp. 1114–1121.

*Primary Examiner*—David R. Hudspeth
*Assistant Examiner*—Martin Lerner
*Attorney, Agent, or Firm*—Ostrolenk, Faber, Gerb & Soffen, LLP

[57] ABSTRACT

A coding and decoding system includes a first filter for representing an input signal with first linear prediction coefficients indicative of a coarse spectral distribution of the input signal, a second filter for representing the input signal with second linear filter means connected in series with or parallel to the second filter for representing the input signal with third linear prediction coefficients indicative of a periodic component of the input signal. A coding and decoding of the input signal is performed on the basis of parameters of the input signal which is produced on the basis of a residual signal between the input signal and a reproduced signal obtained through the first, second and third filters.

19 Claims, 12 Drawing Sheets

CODING AND DECODING SYSTEM FOR SPEECH AND MUSICAL SOUND

BACKGROUND OF THE INVENTION

The present invention claims priority to Japanese Patent Application No.9-072550 filed Mar. 26, 1997, which is incorporated herein by reference.

1. Field of the Invention

The present invention relates to a coding and decoding system for speech and musical sound and, particularly, to a coding and decoding system for speech and musical sound in a telephone-bandwidth.

2. Description of Related Art

A coder for coding speech at low bit rate to make sound quality thereof high, which utilizes the Code Excited Linear Prediction Coding (CELP) system, has been known. The CELP system itself is described in detail in, for example, "Code-Excited Linear Prediction: High Quality Speech at Very Low Bit Rates", IEEE Proc. ICASSP-85, pp. 937–940, 1985.

In the CELP system, the coding is performed by using frame characteristic parameters obtained from every frame (for example, 40 msec) of a speech signal and sub-frame characteristic parameters obtained from every subframe (for example, 8 msec) obtained by dividing the frame by 5 in this example. The frame characteristic parameters include coefficients of a linear prediction (LP) synthesis filter, indicative of a coarse spectrums. The sub-frame characteristic parameters include a lag of a pitch linear prediction synthesis filter indicative of a fine spectrum of such as pitch period, a code vector indicative of a residual signal of the pitch linear prediction filter and a gain of the code vector, etc. The code vector is preliminarily produced on the basis of a signal to be practically coded and a random number, etc.

On the other hand, in a case where musical sound is coded and decoded according to the CELP system, sound quality of a coded sound is degraded by the pitch linear prediction filter and the code vector which are indicative of a periodic structure of musical sound since the spectral structure of the musical sound is complex. In order to solve this problem, a coding and decoding system which uses a high order linear prediction filter in lieu of the pitch linear prediction filter has been proposed.

Linear prediction coefficients used in the high order linear prediction filter are calculated by using a reproduced signal decoded by the past sub-frames. Therefore, this filter is known as a backward linear prediction filter. In order to calculate the coefficients of the backward linear prediction filter, the reproduced signal decoded up to a sub-frame preceding a current sub-frame is first analyzed by linear prediction at a low order. Then, the residual signal of the reproduced signal is obtained by using an inverse filter constructed with the linear prediction coefficients obtained by this analysis to remove the coarse spectrum is flattened, of the reproduced signal. Since the spectrum except for its fine configurations, the inverse filter and circuits subsequent thereto are called a flattening linear prediction filter.

The backward linear prediction coefficients are obtained by a linear prediction analysis of the residual signal at high order. This coding and decoding system is disclosed in for example, S. Sasaki et al., "Improved CELP Coding for Audio Signal," Proc. Acoustical Society of Japan, 1-4-23, pp. 263–264 (March 1996) and an example of the backward linear prediction is disclosed in: "A Low-Delay CELP Coder for CCITT 16 kb/s Speech Coding Standard", IEEE Journal on Selected Areas in Communications", Vol. 10, No. 5, June, 1992.

An operation of the conventional coding and decoding system will be described with reference to FIGS. 1 to 3.

FIG. 1 is a block diagram showing an example of the conventional coding device. In FIG. 1, a signal to be coded is input to an input terminal 1. A frame division circuit (FD) 2 produces frame signals by dividing the input signal into frame signals having a predetermined frame length.

A signal processing in a frame unit will be described first. A sub-frame division circuit (SFD) 6 produces sub-frame signals by dividing a frame signal into sub-frames having a predetermined sub-frame length. A linear prediction analyzer (LPA) 3 produces linear prediction coefficients by a linear prediction analysis of the frame signal. A filter coefficient quantizer (FCQ) 4 produces quantized linear prediction coefficients and a filter coefficient quantizing index by quantizing the linear prediction coefficients.

A filter coefficient interpolation circuit (FCI) 5 produces interpolated quantized linear prediction coefficients a to be used in the respective sub-frames by interpolating the quantizing linear prediction coefficients obtained from the past frames and the quantizing linear prediction coefficients of the current frame. A filter coefficient interpolation circuit (FCI) 7 produces interpolated linear prediction coefficients w to be used in the respective sub-frames by interpolating the linear prediction coefficients obtained from the past frames and the linear prediction coefficients obtained for the current frame.

Now, a signal processing in each sub-frame unit will be described. A backward analyzer (BWA) 34 accumulates the reproduced signals supplied from a synthesizing filter (SYNTH) 22 for the past sub-frames and calculates backward linear prediction coefficients b indicative of a fine spectral distribution from the accumulated, reproduced signal. A weighting filter (WEIGHT) 25 produces a weighted sub-frame signal without noise by filtering the sub-frame signal using a filter constructed with the interpolated linear prediction coefficients w.

An excitation code book circuit (ECB) 16 accumulates a plurality of code vectors each of sub-frame length, that is, waveform patterns, preliminarily produced from random numbers, etc., and outputs the code vectors (the waveform patterns) sequentially according to the index supplied from an error evaluation circuit (ERR) 35. A predetermined number of code vectors having corresponding indices are preliminarily prepared.

A gain code book circuit (GCB) 32 includes a table (not shown) containing gain values for regulating amplitudes of the code vectors and outputs the gain values according to the indices supplied from the error evaluation circuit 35. A predetermined number of the gain values are prepared and have the indices corresponding thereto, respectively. A multiplier 18 produces a code vector excitation candidate signal by multiplying the code vector output from the excitation code book circuit 16 with the gain value of the code vector output from the gain code book circuit (GCB) 32.

A backward filter (BWF) 10 obtains a reproduced excitation candidate signal by filtering the code vector excitation candidate signal using a filter constructed with the backward linear prediction coefficients b supplied from the backward analyzer 34. A synthesizing filter (SYNTH) 11 obtains a reproduced candidate signal by filtering the reproduced excitation candidate signal from the backward filter 10 using a filter constructed with the quantizing linear prediction coefficients a indicative of the coarse spectral distribution. A weighting filter (WEIGHT) 12 obtains a weighted, reproduced candidate signal having no noise by filtering the reproduced candidate signal using a filter constructed with the interpolated linear prediction coefficients w.

A difference circuit 13 subtracts the weighted reproduced candidate signal from the weighted sub-frame signal and obtains a difference signal. The error evaluation circuit 35 supplies the indices to the excitation code book circuit 16 and the gain code book circuit 32 sequentially correspondingly thereto and calculates a square sum of the difference signal calculated by the difference circuit 13 for every combination of the code vector and the gain value corresponding to the index supplied thereto.

In performing this calculation sequentially, the error evaluation circuit 35 supplies an update flag to a gate circuit 33 when a smaller square sum is found. Further, after square sums for all combinations are calculated, the error evaluation circuit 35 selects an index corresponding to the code vector and the gain value whose square sum is minimum and sends it to an multiplexer (MUX)36 as a excitation quantizing index.

The gate circuit 33 replaces the code vector excitation candidate signal stored therein with a code vector excitation candidate signal output from the multiplier 18 only when the error evaluation circuit 35 supplies the update flag thereto. Further, after the calculation of the square sums for all of the combinations is completed in the error evaluation circuit 35, the gate circuit 33 outputs the stored code vector excitation candidate signal as a reproduced excitation signal.

A backward filter (BWF) 21 produces a reproduced excitation signal by filtering the reproduced excitation signal output from the gate circuit 33 using a filter constructed with the backward linear prediction coefficients b. A synthesizing filter 22 produces a reproduced signal by filtering the reproduced excitation signal using a filter constructed with the interpolated quantized linear prediction coefficients a and supplies it to the backward analyzer 34. This reproduced signal is a decoded signal corresponding to the input signal.

The multiplexer 36 outputs a transmission data obtained by multiplexing the filter coefficients quantizing index output from the filter coefficient quantizer 4 with the excitation quantizing index output from the error evaluation circuit 35 to an output terminal 24.

FIG. 2 is a block diagram showing an example of a construction of the backward analyzer 34. In FIG. 2, a signal processing portion of the backward analyzer 34, which includes a window processing circuit (WIN) 34*b*, a correlation calculator (CORR) 34*c* and a Levinson Durbin circuit (LD) 34*d*, and another signal processing portion thereof which includes a window processing circuit (WIN) 34*f*, a correlation calculator circuit (CORR) 34*g* and a Levinson Durbin circuit (LD) 34*h* realizes a linear prediction analysis method utilizing an auto-correlation method. Although only the auto-correlation method is described in this specification, such method may be replaced by other linear prediction analysis method.

The linear prediction analysis itself is described in detail in, for example, J. R. Deller, "Discrete-Time Processing of Speech Signals", Macmillan Pub., 1993.

The construction of the backward analyzer 34 will be described with reference to FIG. 2. The window processing circuit 34*b* performs an analysis windowing of the reproduced signal input to an input terminal 34*a*. The correlation calculator 3 4*c* calculates a first auto-correlation value from the windowed signal. The Levinson Durbin circuit 34*d* calculates flattening linear prediction coefficients for flattening the spectrum from the first auto-correlation value. An inverse filter (INV) 34*e* produces a predicted residual signal of the reproduced signal by using a flattening linear prediction filter constituting the flattening linear prediction coefficients.

The window processing circuit 34*f* performs an analysis windowing of the predicted residual signal. The auto-correlation calculator 34*g* calculates a second auto-correlation value from the windowed predicted residual signal. The Levinson Durbin circuit 34*h* calculates the backward linear prediction coefficients b from the second auto-correlation value and outputs them to an output terminal 34*i*.

FIG. 3 is a block diagram showing an example of the conventional decoder device. A demultiplexer (DEMUX) 37 produces an index corresponding to linear prediction coefficients, a code vector and its gain value by using the transmission data input from the input terminal 26. A filter coefficient decoder (FCD) 38 decodes the quantizing linear prediction coefficients from the index of the linear prediction coefficients. The filter coefficient interpolation circuit 5 produces the interpolated quantized linear prediction coefficients a to be used in the respective sub-frames, by interpolating the decoded quantizing linear prediction coefficients and the quantizing linear prediction coefficients decoded in a preceding frame.

The excitation code book circuit 16 outputs a code vector according to the index of the code vector. The gain code book circuit 32 outputs a gain value according to the index of gain value. The multiplier 18 produces a first reproduced excitation signal by multiplying the code vector with the gain value. The backward analyzer 34 accumulates the reproduced signals supplied from the synthesizing filter 11 in the past frames and calculates the backward linear prediction coefficients b from the stored, reproduced signals.

The backward filter 10 produces a second reproduced excitation signal by filtering the first reproduced excitation signal using a filter constructed with the backward linear prediction coefficients b. The synthesis filter 11 produces the reproduced signal by filtering the second reproduced excitation signal using a filter constructed with the interpolated quantized linear prediction coefficients a. The reproduced signal is output from an output terminal 29.

In the conventional speech coding and decoding device mentioned above, the periodic structure of the input speech signal is obtained by using only the backward linear prediction filter, which is not based on the speech signal producing model. Therefore, the coding performance thereof with respect to a speech signal is low.

Further, in the conventional speech coding and decoding device, the backward linear prediction coefficients are calculated by the linear prediction analysis of the reproduced signal whose spectrum is flattened. Therefore, a large amount of arithmetic operation is required.

SUMMARY OF THE INVENTION

An object of the present invention is to provide a coding and decoding system for speech signal and musical sound signal, which can code the speech signal and the musical sound signal efficiently with a minimum amount of arithmetic operation.

A coding and decoding system for speech sound signal and musical sound signal according to the present invention comprises first filter means for representing an input signal with first linear prediction coefficients indicative of a coarse spectral distribution of the input signal, second filter means for representing the input signal with second linear prediction coefficients indicative of a fine spectral distribution of the input signal and third filter means connected in series with or parallel to the second filter means for representing the input signal with third linear prediction coefficients indicative of a periodic component of the input signal, wherein a coding and decoding of the input signal is performed on the basis of parameters of the input signal which are produced on the basis of a residual signal between the input signal and a reproduced signal obtained through the first, second and third filter means.

A coder for speech and musical sound according to the present invention comprises first filter means for producing a reproduced speech and musical sound signal with first linear prediction coefficients indicative of a coarse spectral distribution of the speech and musical sound signal, second filter means for producing the reproduced excitation signal of the speech and musical sound signal with second linear prediction coefficients indicative of a fine spectral distribution of the speech and musical sound signal and third filter means for producing the reproduced excitation signal corresponding to the speech and musical sound by using only third linear prediction coefficients indicative of a periodic component of the speech and musical sound signal or using the third linear prediction coefficients and the second linear prediction coefficients and means for producing parameters of the speech and musical sound signal produced on the basis of a residual signal between the speech and musical sound signal and a reproduced signal obtained through the first, second and third filter means.

A speech and musical sound decoder according to the present invention comprises first filter means for producing a reproduced speech and musical sound signal corresponding to an input speech and musical sound signal by using only first linear prediction coefficients indicative of a periodic component of the speech and musical sound signal or using second linear prediction coefficients indicative of a fine spectral distribution of the speech and musical sound signal and the first linear prediction obtained, on the basis of parameters of the input speech and musical sound signal, second filter means for producing the reproduced excitation signal of the speech and musical sound signal by using the second linear prediction coefficients and third filter means for producing the reproduced speech and musical sound signal of the speech and musical sound signal by using third linear prediction coefficients indicative of a coarse spectral distribution of the input speech and musical sound signal.

Another speech and musical sound coding and decoding system according to the present invention comprises a coder comprising first filter means for producing a reproduced speech and musical sound signal with first linear prediction coefficients indicative of a coarse spectral distribution of the speech and musical sound signal, second filter means for producing the reproduced excitation signal of the speech and musical sound signal with second linear prediction coefficients indicative of a fine spectral distribution of the speech and musical sound signal, third filter means for producing the reproduced excitation signal corresponding to the speech and musical sound by using only third linear prediction coefficients indicative of a periodic component of the speech and musical sound signal or using the third linear prediction coefficients and the second linear prediction coefficients and means for producing parameters of the speech and musical sound signal produced on the basis of a residual signal between the speech and musical sound signal and a reproduced signal obtained through the first, second and third filter mean; and a decoder comprising fourth filter means for producing the reproduced excitation signal corresponding to the speech and musical sound signal by using only the third linear prediction coefficients or using the second linear prediction coefficients and the third linear prediction coefficients, on the basis of parameters of the input speech and musical sound signal, fifth filter means for producing the reproduced excitation signal of the speech and musical sound signal by using the second linear prediction coefficients and sixth filter means for producing the reproduced speech and musical sound signal of the speech and musical sound signal by using the first linear prediction coefficients.

That is, in order to represent the excitation signal, the speech and musical sound coding and decoding system according to the present invention uses, in addition to the backward linear prediction filter, the pitch linear prediction filter for efficiently coding the periodic structure of the speech signal. Therefore, it is possible to improve the performance of the system with respect to the speech signal.

The backward linear prediction coefficients are calculated by using only the correlation value calculated from the reproduced signal in the respective sub-frames and the flattening linear prediction coefficients calculated from the correlation value. Therefore, there is no need to perform the analysis window processing, the spectrum flattening processing of the reproduced signal and the correlation calculation processing of the flattened signal which are necessary in the conventional coding and decoding system. As a result, it is possible to substantially reduce the amount of arithmetic operations required for calculation of the backward linear prediction coefficients.

The reproduced excitation signal can be considered as being able to be approximated by a signal obtained by flattening the spectrum of the reproduced signal. Therefore, it is not necessary to perform the analysis window processing, the spectrum flattening processing of the reproduced signal and the correlation calculation processing of the flattened signal which are necessary in the conventional coding and decoding system.

BRIEF DESCRIPTION OF THE DRAWINGS

The above mentioned and other objects, features and advantages of the present invention will become more apparent by reference to the following detailed description of the invention taken in conjunction with the accompanying drawings, wherein.

DETAILED DESCRIPTION OF PREFERRED EMBODIMENTS

Figure 1:
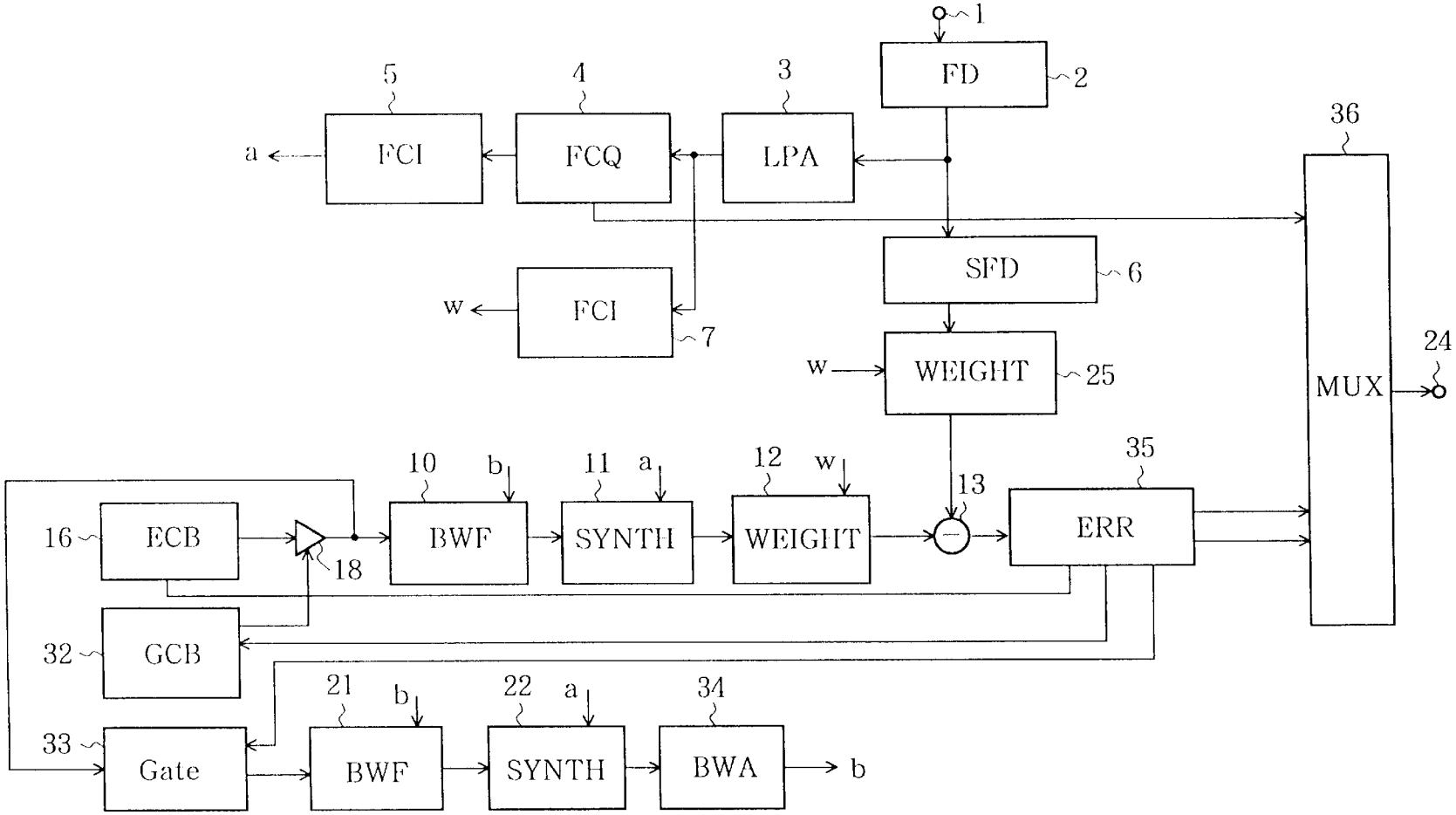
Prior Art FIG.1
FIG. 1 is a block diagram showing a construction of a conventional coder.
Figure 2:
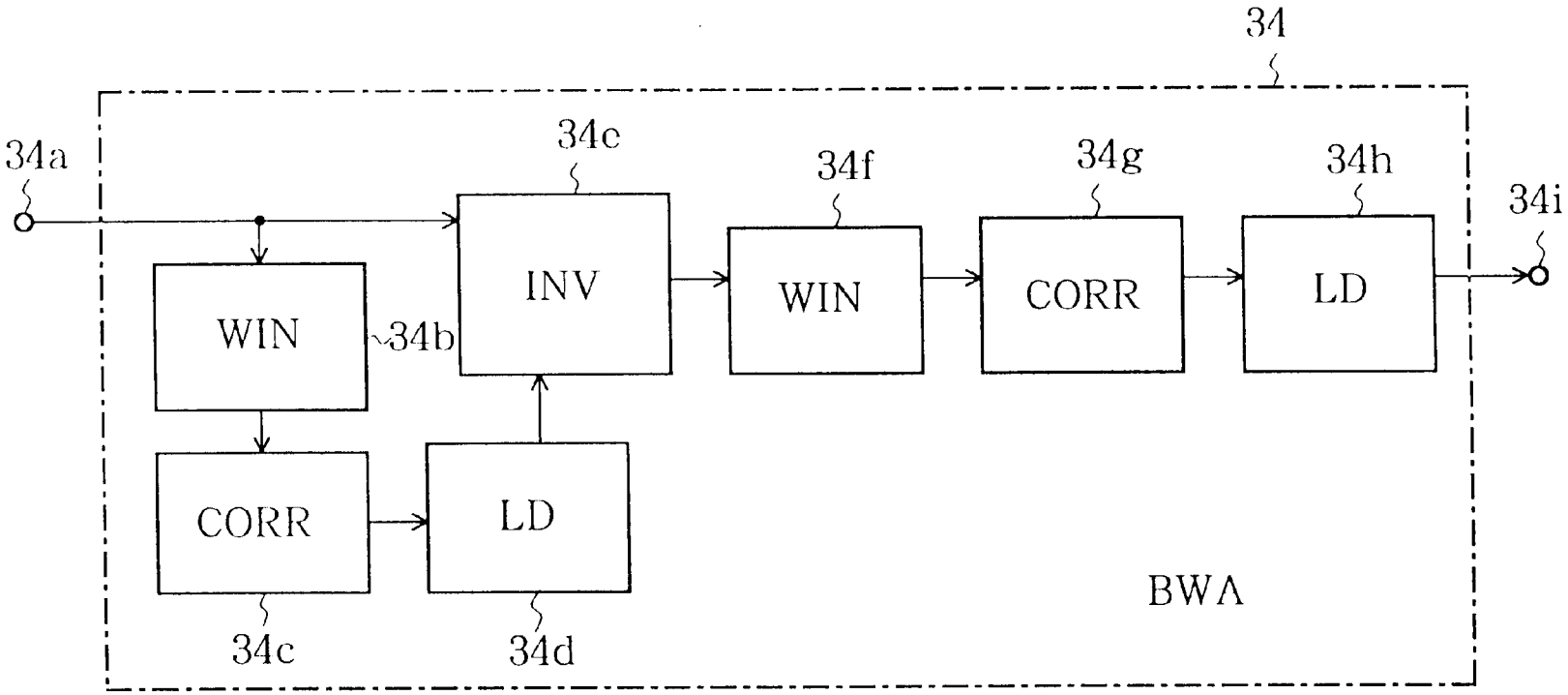
Prior Art FIG.2
FIG. 2 is a block diagram showing a construction of a backward analyzer shown in FIG. 1.
Figure 4:
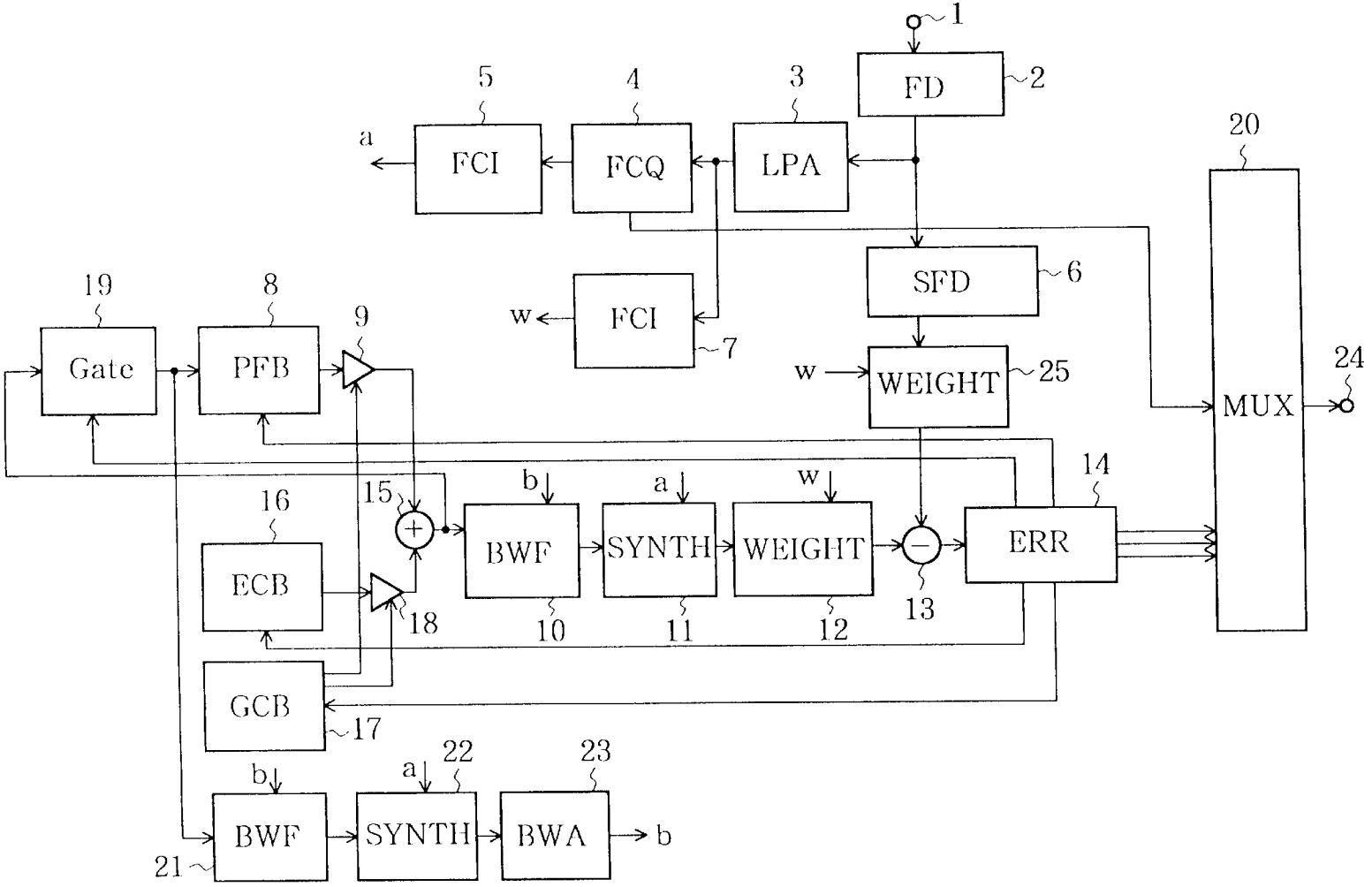
FIG. 4 is a block diagram showing a construction of a coder according to an embodiment of the present invention.

The embodiments of the present invention will be described with reference to the drawings. FIG. 4 shows a construction of a coder according to an embodiment of the present invention In FIG. 4, the coder of the present invention is similar in construction to the conventional coder shown in FIG. 1 except that a pitch filter buffer (PFB) 8, an accumulator and an adder 15 are added and a gain code book circuit 17, an error evaluation circuit 14, a multiplexer 20 and a backward analyzer 23 are used in lieu of the gain code book circuit 32, the error evaluation circuit 35 the multiplexer 36 and the backward analyzer 34 of the conventional coder shown in FIG. 1, respectively. In FIG. 4, the same constructive components as those shown in FIG. 1 are depicted by the same reference numerals, as the operations of the corresponding constructive components are similar. Therefore, only the components which are different from those shown in FIG. 1 and circuits which are influenced by these components will be described below.

The operations of the newly added circuits and the substituted circuits will be described first. The pitch filter buffer 8 stores a predetermined length of a connected reproduced excitation candidate signal obtained by connecting the reproduced excitation signal from the gate circuit 19. Further, the pitch filter buffer 8 outputs a pitch vector (periodic component) obtained by cutting out the stored connected reproduced excitation signal by a sub-frame length according to the index sequentially supplied from the error evaluation circuit 14.

The multiplier 9 multiplies the pitch vector output from the pitch filter buffer 8 with the gain value of the pitch vector output from the gain code book circuit 17 and obtains a pitch excitation candidate signal. The adder 15 adds the pitch excitation candidate signal from the multiplier 9 to the code vector excitation candidate signal from the multiplier 18 and supplies a resultant excitation candidate signal to the backward filter 10 and the gate circuit 19.

The gain code book circuit 17 includes a table (not shown) constructed with a two dimensional vectors each containing two gain values for regulating amplitudes of the code vector and the pitch vector. A predetermined number of the two dimensional vectors are prepared which have indices corresponding thereto. Further, the gain code book circuit 17 supplies the gain value of the code vector contained in the two dimensional vector of the index supplied from the error evaluation circuit 14 to the multiplier 18 and the gain value of the pitch vector to the multiplier 9.

The error evaluation circuit 14 sequentially supplies indices corresponding to the pitch filter buffer 8, the excitation code book circuit 16 and the gain code book circuit 17 and calculates a square sum of the difference signal calculated by the difference circuit 13 for every combination of the gain values of the pitch vector and the code vector corresponding to the respective indices. In performing the calculations sequentially, the error evaluation circuit 14 supplies an update flag to the gate circuit 19 when a smaller square sum is found.

Further, after the error evaluation circuit 14 calculates the square sums for all combinations of the gain values of the pitch and code vectors, the error evaluation circuit 14 selects an index corresponding to the gain values of the pitch and code vectors whose square sum is minimal and supplies the index to the multiplexer 20 as an excitation quantizing index. The multiplexer 20 outputs the transmission data obtained by totalizing the filter coefficient quantizing index from the filter coefficient quantizer 4 and the excitation quantizing index from the error evaluation circuit 14 to the output terminal 24.

Now, circuits whose input and output are changed by the added circuits and the substituted circuits will be described below. The excitation code book circuit 16 accumulates the preliminarily produced code vectors of sub-frame length, that is, waveform patterns, and outputs the code vectors sequentially according to the indices supplied from the error evaluation circuit 14. The multiplier 18 produces the reproduced excitation candidate signal by multiplying the code vector output from the excitation code book circuit 16 with the gain values of the code vector.

When the gate circuit 19 receives the update flag from the error evaluation circuit 14, the gate circuit 19 replaces the stored signal by the reproduced excitation candidate signal output from the adder 15 and accumulates it. Further, the gate circuit 19 outputs the stored, reproduced excitation candidate signal as the reproduced excitation signal when the calculation of the square sums for all combinations is completed.

Figure 3:
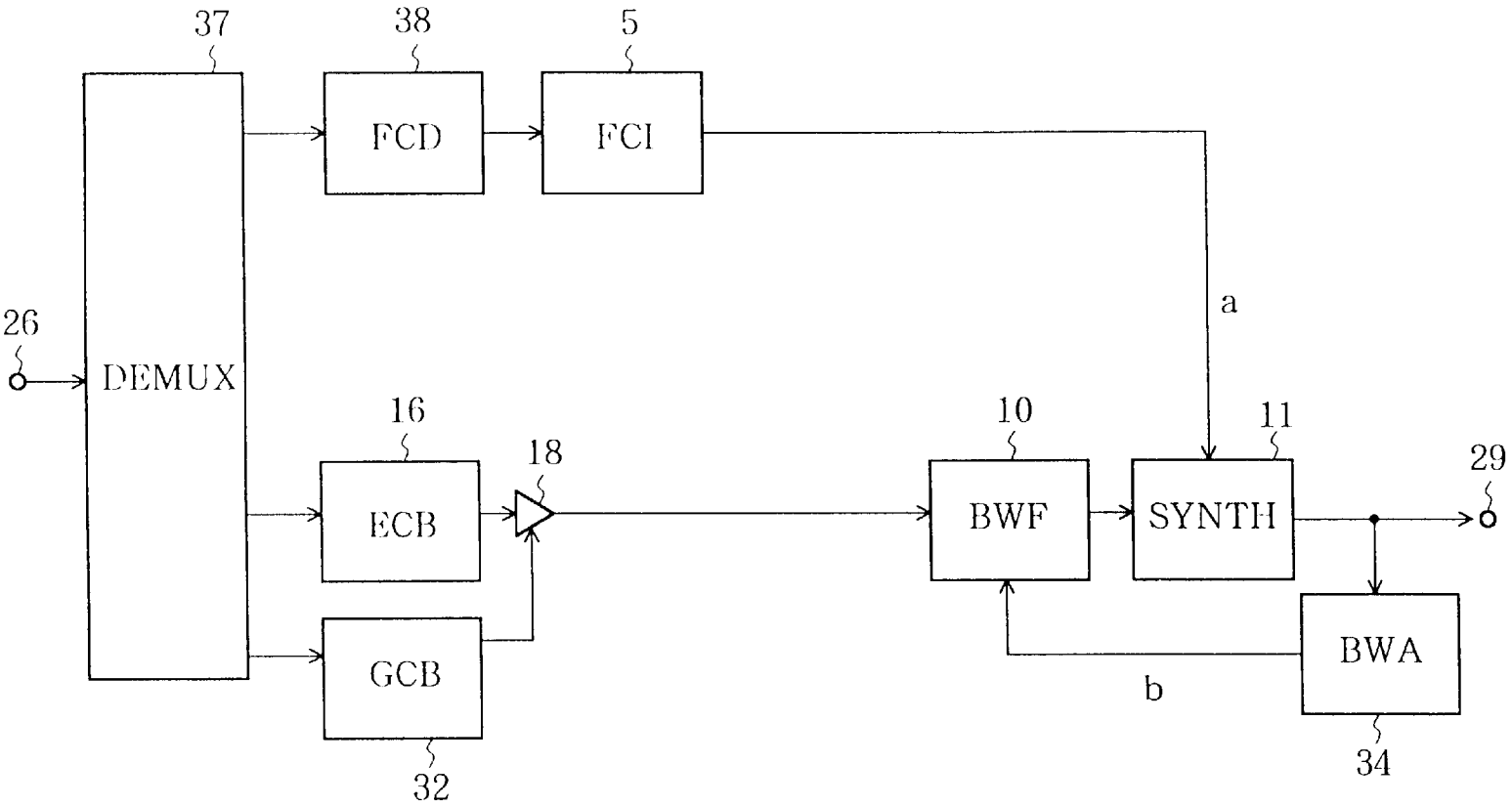
Prior Art FIG.3
FIG. 3 is a block diagram showing a construction of a conventional decoder.
Figure 5:
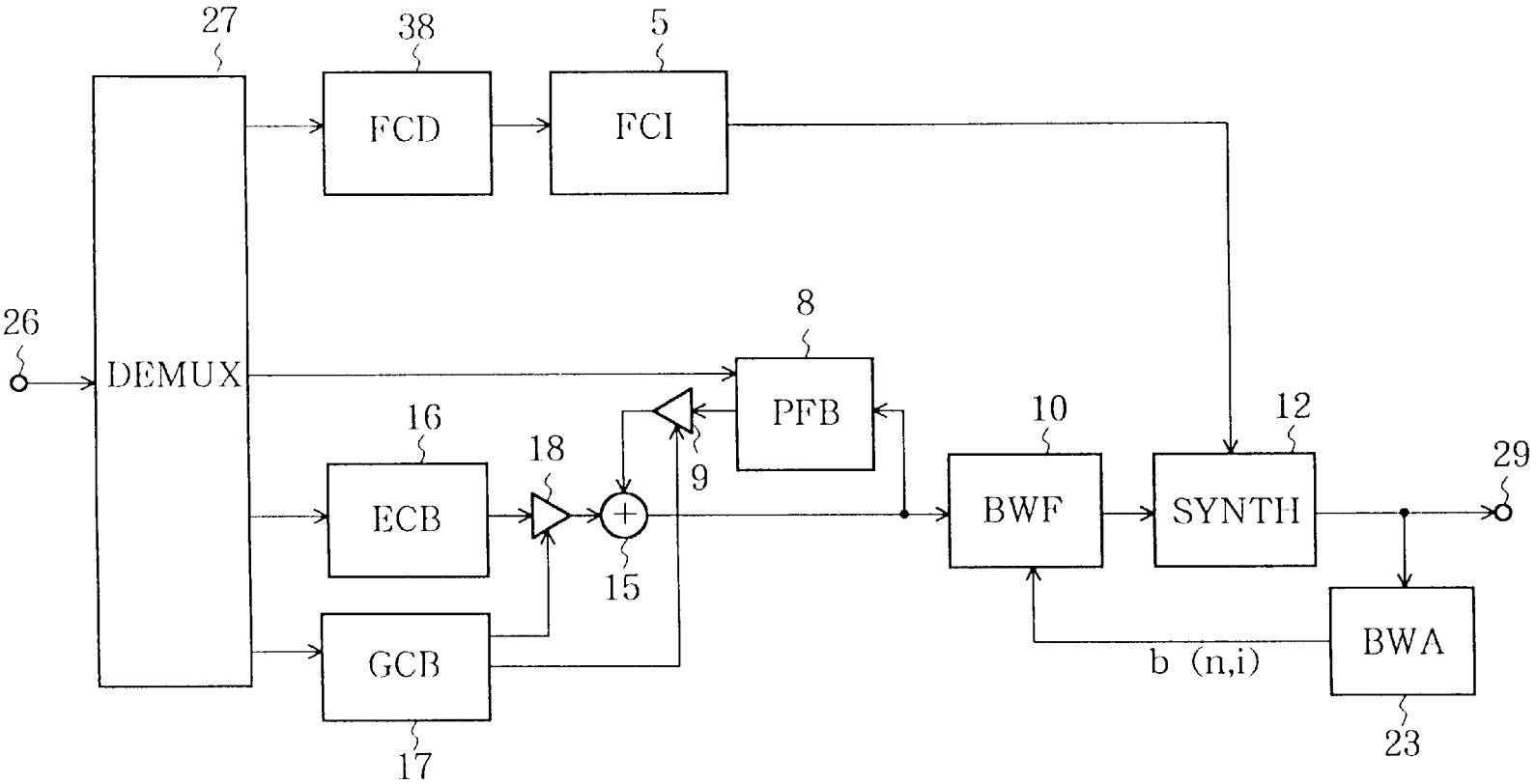
FIG. 5 is a block diagram showing a construction of a decoder according to an embodiment of the present invention.

FIG. 5 shows a construction of a decoder according to an embodiment of the present invention. In FIG. 5, the decoder decodes the transmission data obtained by the coder mentioned above. The decoder of the present invention is similar in construction to the conventional decoder shown in FIG. 3 except that a pitch filter buffer 8 and an adder 9 are added and a demultiplexer 27, a gain code book circuit 17 and backward analyzer 23 are used in lieu of the demultiplexer 37, the gain code book circuit 32 and the backward analyzer 34 of the conventional decoder shown in FIG. 3, respectively. In FIG. 5, same constructive components as those shown in FIG. 3 are depicted by the same reference numerals as the operations of the corresponding constructive components are similar. Therefore, only the components which are different from those shown in FIG. 3 and circuits which are influenced by these components will be described below.

The operations of the newly added circuits and the substituted circuits will be described first. A multiplier 9 produces a pitch excitation candidate signal by multiplying a pitch vector with a gain value. A multiplier 18 produces a code book excitation signal by multiplying a code vector supplied from a code book circuit 16 with a gain value.

A pitch filter buffer 8 stores a predetermined length of a signal obtained by connecting the reproduced excitation signal output from the gate circuit 19. Further, the pitch filter buffer 8 outputs a pitch vector (periodic component) obtained by cutting out the stored reproduced excitation signal of a sub-frame length to the multiplier 9 according to an index of the pitch vector output from the demultiplexer 27.

The demultiplexer 27 produces indices corresponding to linear prediction coefficients, the pitch vector, the code vector and gain values thereof by using the transmission data input from an input terminal 26. The gain code book circuit 17 supplies the gain value of the pitch vector to the multiplier 9 and the gain value of the code vector to the multiplier 18 according to the indices corresponding to the gain value.

Circuits whose input and output are changed by the added circuits and the substituted circuits will be described next. The adder 15 is constructed such that it supplies the reproduced excitation candidate signal obtained by adding the pitch excitation candidate signal to the code book excitation signal to the backward filter 10.

Figure 6:
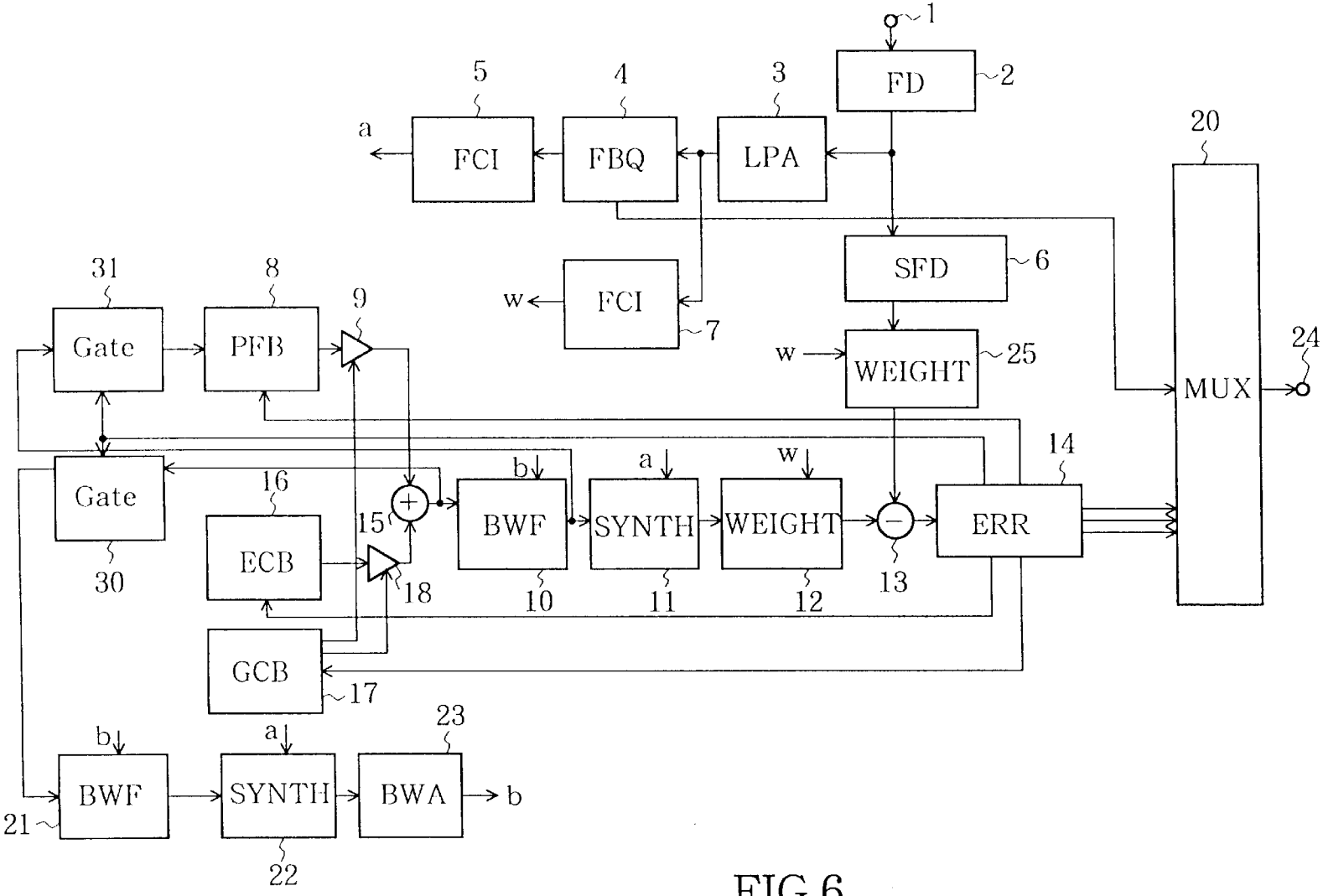
FIG. 6 is a block diagram showing a construction of a coder according to another embodiment of the present invention.

FIG. 6 is a block diagram showing a construction of a coder according to another embodiment of the present invention. In FIG. 6, the coder of the present invention is similar in construction to the coder shown in FIG. 4 except that the pitch prediction filter and the high order linear prediction filter are connected in parallel to each. The same constructive components as those in FIG. 4 are depicted by the same reference numerals, as the operations of the corresponding constructive components.

When the high order linear prediction filter is connected in parallel to the pitch prediction filter, the high order linear prediction filter is influenced by the pitch linear prediction filter for only tap coefficients corresponding to a lag value of the pitch linear prediction filter. Therefore, when a transmission path error occurs in the transmission data of the pitch linear prediction filter, it is possible to restrict the influence to tone degradation related to the tap coefficients.

The coder according to this embodiment of the present invention is similar in construction to the coder shown in FIG. 4 except that a gate circuit 30 is added and a signal input to a pitch filter buffer 8 is different from that in FIG. 4. An operation of the added circuit will be described next.

The gate circuit 30 replaces the signal stored therein by the reproduced excitation candidate signal output from the backward filter l0 when it receives the update flag from the error evaluation circuit 14 and stores the reproduced excitation candidate signal. Further, the gate circuit 30 outputs the reproduced excitation candidate signal stored therein as a reproduced excitation signal when the calculation of the square sums for all of the combinations is completed.

The circuits whose inputs and outputs are changed by the addition of the gate circuit 30 will be described next. The pitch filter buffer 8 stores the reproduced excitation signal from the backward filter 10 output from the gate circuit 31. Further, the pitch filter buffer 8 is constructed such tat it supplies a pitch vector obtained by cutting out a signal continuing by a sub-frame length from the reproduced excitation signal stored therein to the multiplier 9.

Figure 7:
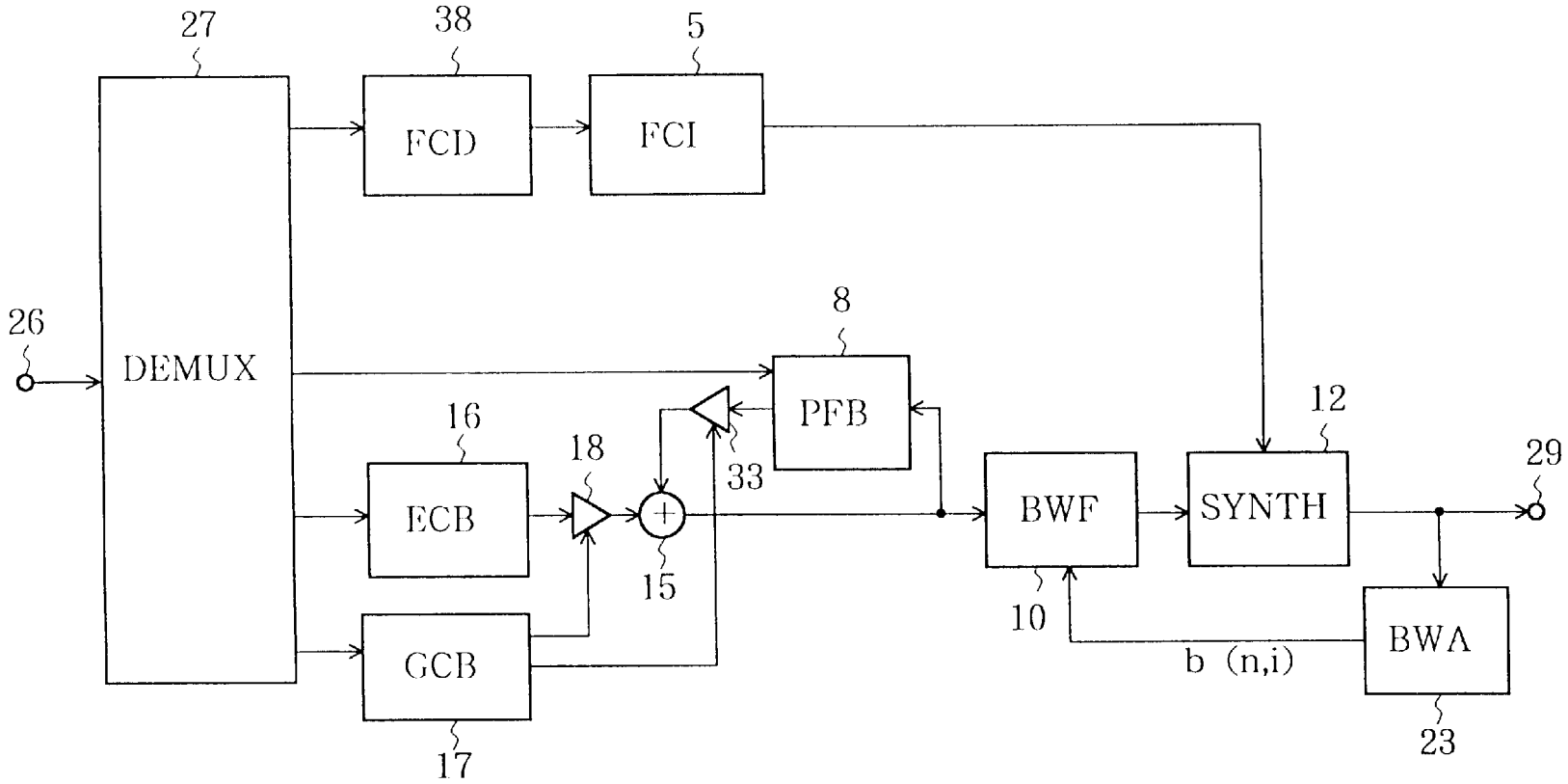
FIG. 7 is a block diagram showing a construction of a decoder according to another embodiment of the present invention.

FIG. 7 is a block diagram showing a construction of a decoder according another embodiment of the present invention. In FIG. 7, the decoder of the present invention decodes the transmission data obtained by the coder shown in FIG. 6. The decoder shown in FIG. 7 is similar in construction to the decoder shown in FIG. 5 except that an input signal to the pitch filter buffer 8 is different; The same constructive components as those in FIG. 5 are depicted by the same reference numerals, as the operations of the corresponding constructive components are similar. Therefore, only the pitch filter buffer 8 will be described below.

The pitch filter buffer 8 stores the reproduced excitation signal supplied from the backward filter 10 and supplies the pitch vector obtained by cutting out the stored reproduced excitation signal of sub-frame length to the multiplier 33.

Figure 8:
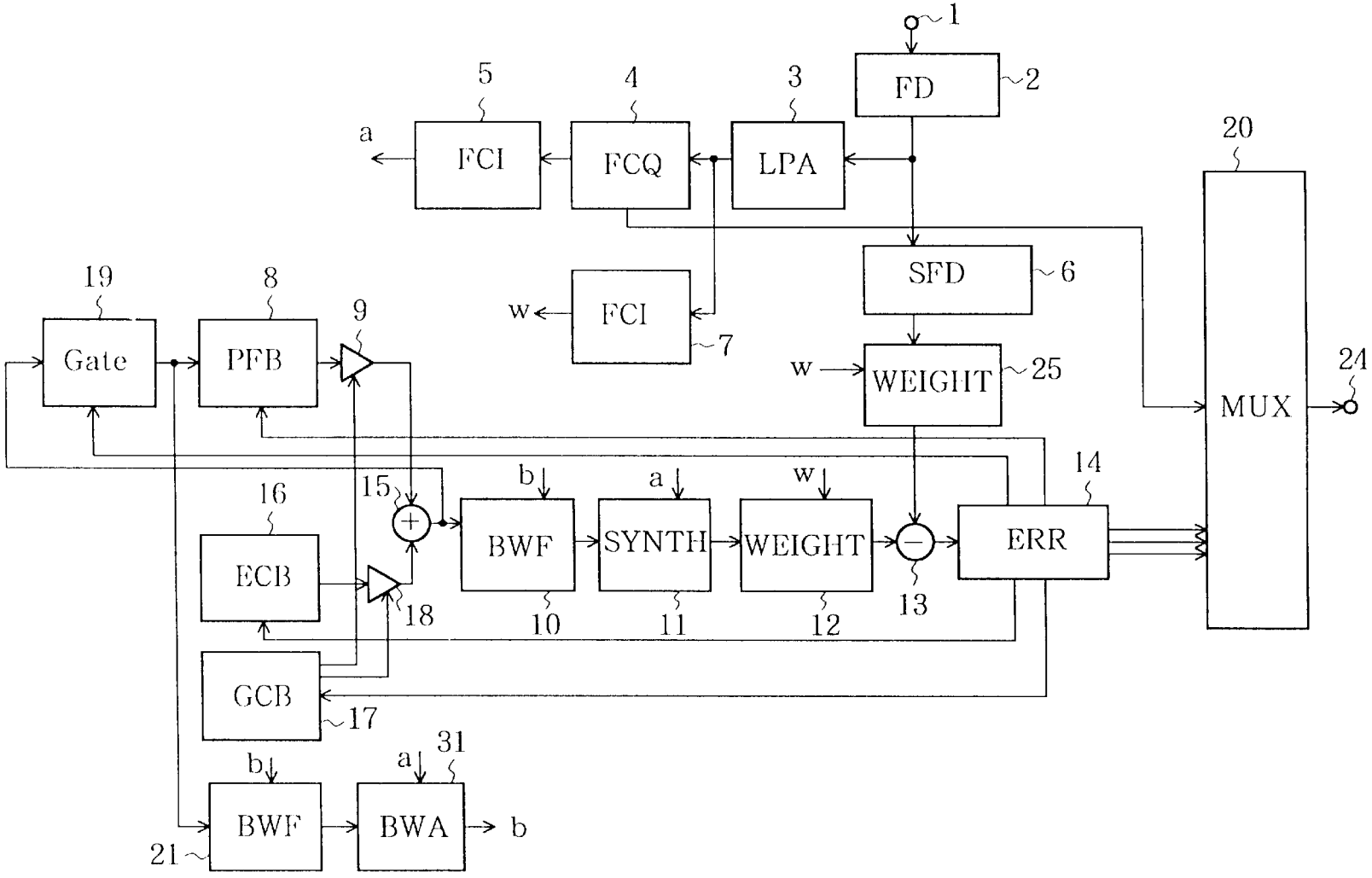
FIG. 8 is a block diagram showing a construction of a coder according to another embodiment of the present invention.

FIG. 8 is a block diagram showing a construction of a coder according to another embodiment of the present invention. In FIG. 8, the coder is similar in construction to the coder shown in FIG. 4 except that the backward linear prediction coefficients are calculated from the reproduced excitation signal; The same constructive components as those in FIG. 4 are depicted by the same reference numerals, as the operations of the corresponding constructive components are similar.

That is, in the coder shown in FIG. 8, the backward analyzer 23 of the coder shown in FIG. 4 is replaced by a backward analyzer 31 for calculating the backward linear prediction coefficients from the reproduced excitation signal.

In the coder shown in FIG. 8, the backward filter 21 preceding the backward analyzer 31 obtains-the reproduced excitation signal by filtering the reproduced excitation signal by a filter constructed with the backward linear prediction coefficients b and supplies the reproduced excitation signal to the backward analyzer 31. The backward analyzer 31 stores the reproduced excitation signals supplied from the backward filter 21 in the past sub-frames and calculates the backward linear prediction coefficients b indicative of fine spectral distributions from the stored reproduced excitation signals.

Figure 9:
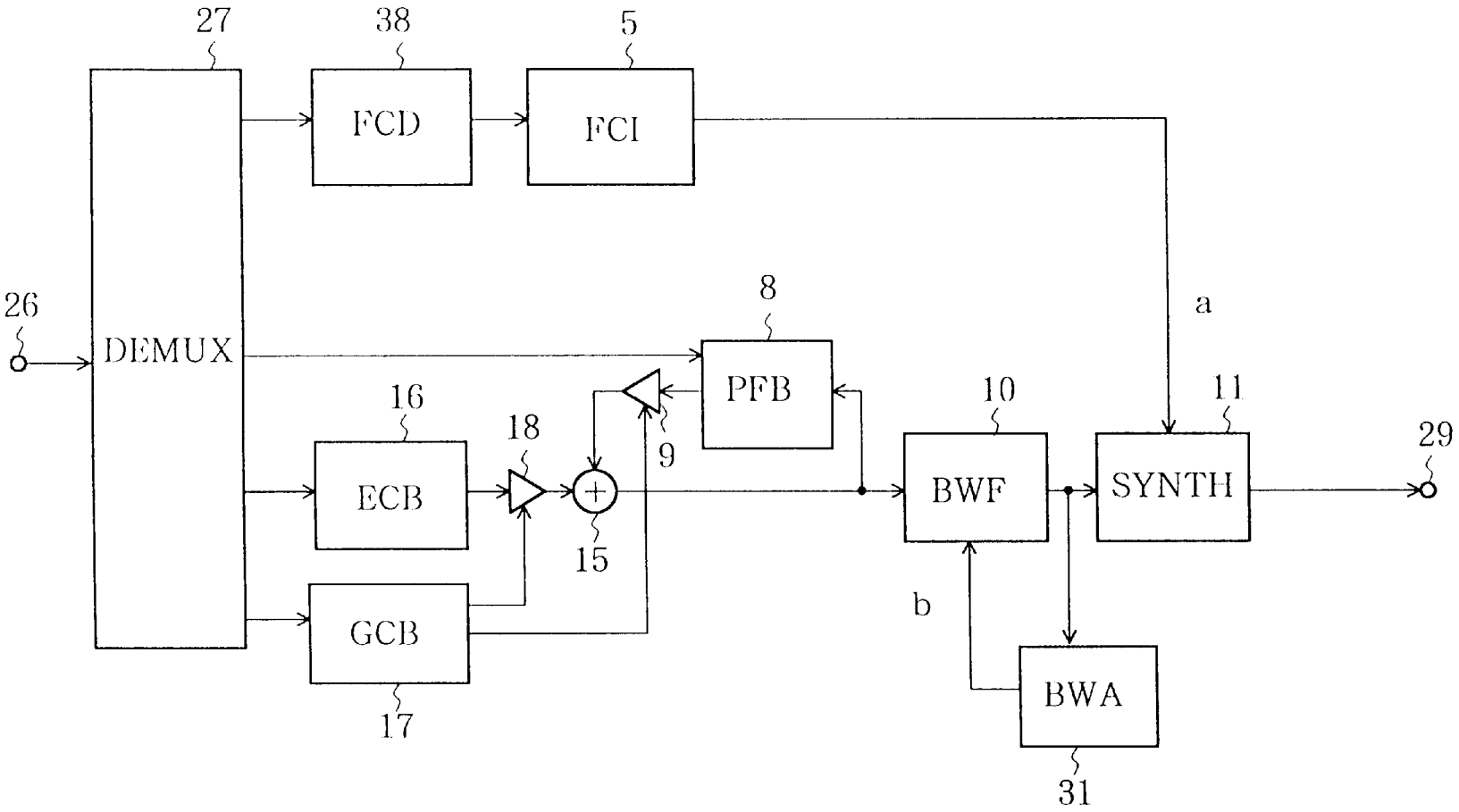
FIG. 9 is a block diagram showing a construction of a decoder according to another embodiment of the present invention.

FIG. 9 is a block diagram showing a construction of a decoder according to another embodiment of the present invention. In FIG. 9, the decoder is similar in construction to the decoder shown in FIG. 5 except that the backward linear prediction coefficients are calculated from the reproduced excitation signal. The same constructive components as those in FIG. 5 are depicted by the same reference numerals as the operations of those constructive components are similar.

That is, in the decoder shown in FIG. 9, the backward analyzer 23 of the decoder shown in FIG. 5 is replaced by a backward analyzer 31 for calculating the backward linear prediction coefficients from the reproduced excitation signal.

In the decoder shown in FIG. 9, a signal input to the backward analyzer 31 is the reproduced excitation signal not from the synthesizing filter 11 but from the backward filter 10. Therefore, the backward analyzer 31 stores the reproduced excitation signals supplied from the backward filter 10 in the past sub-frames and calculates the backward linear prediction coefficients b indicative of fine spectral distributions from the stored, reproduced excitation signals.

Figure 10:
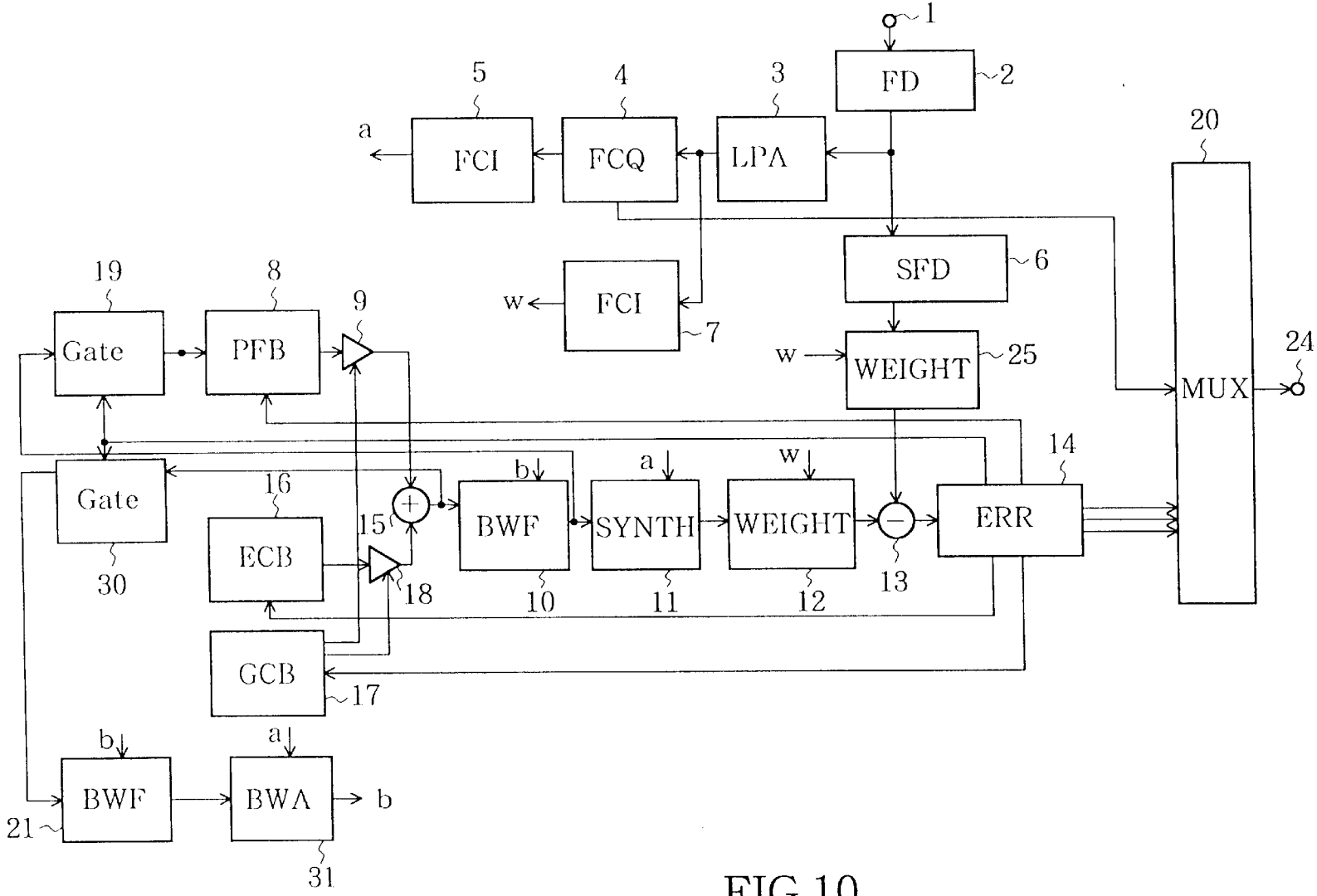
FIG. 10 is a block diagram showing a construction of a coder according to another embodiment of the present invention.

FIG. 10 is a block diagram showing a construction of a coder according to another embodiment of the present invention. In FIG. 10, the coder is similar in construction to the coder shown in FIG. 6 except that the backward linear prediction coefficients b are calculated from the reproduced excitation signal. The same constructive components as those in FIG. 6 are depicted by the same reference numerals, and the operations of those constructive components are similar.

That is, in the coder shown in FIG. 10, the backward analyzer 23 of the coder shown in FIG. 6 is replaced by a backward analyzer 31 for calculating the backward linear prediction coefficients from the reproduced excitation signal.

In the coder shown in FIG. 10, the backward filter 21 preceding the backward analyzer 31 obtains the reproduced excitation signal by filtering the reproduced excitation signal from the gate circuit 30 by a filter constructed with the backward linear prediction coefficients b and supplies the reproduced excitation signal to the backward analyzer 31. The backward analyzer 31 stores the reproduced excitation signals supplied from the backward filter 21 in the past sub-frames and calculates the backward linear prediction coefficients b indicative of fine spectral distributions from the stored reproduced excitation signals.

Figure 11:
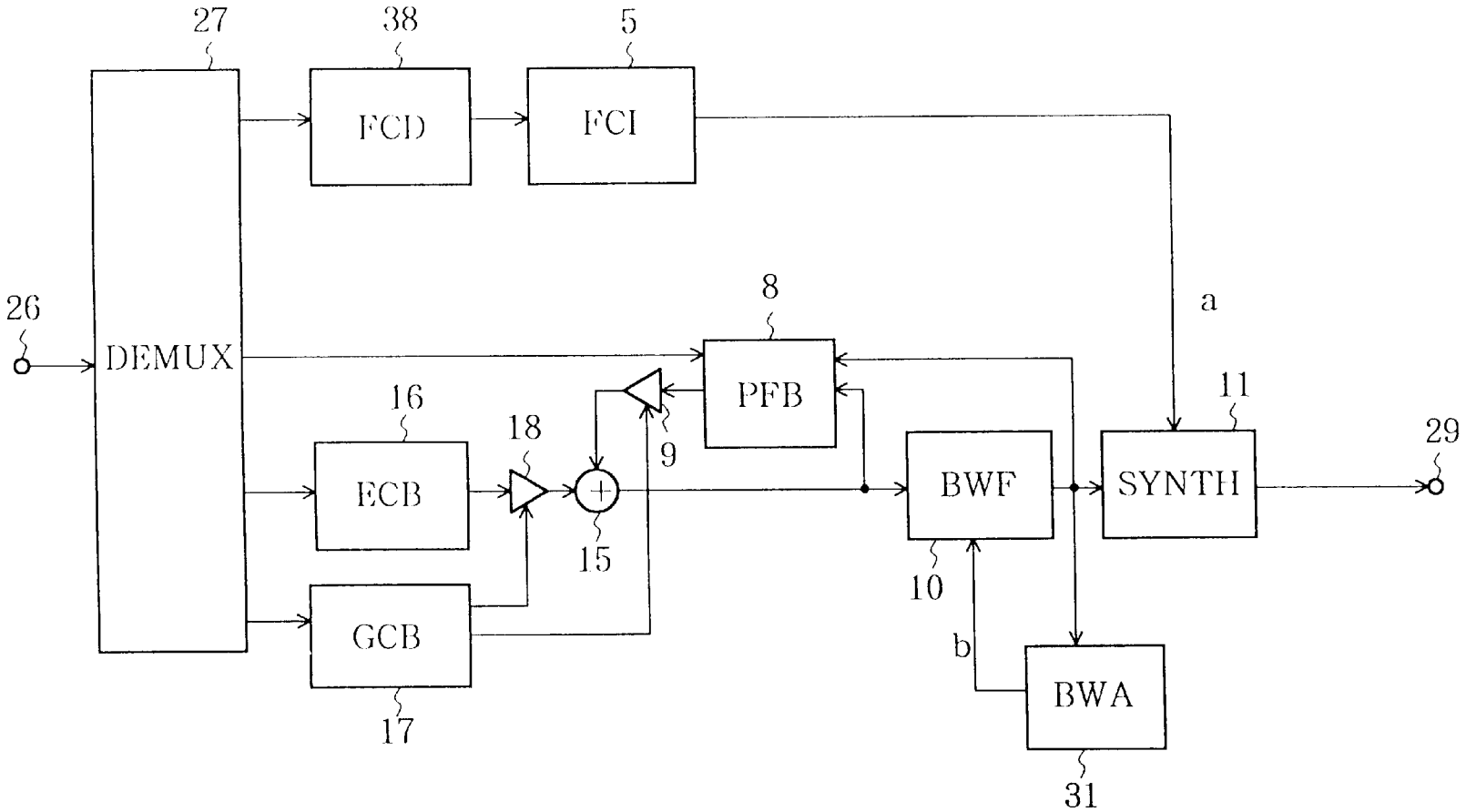
FIG. 11 is a block diagram showing a construction of a decoder according to another embodiment of the present invention.

FIG. 11 is a block diagram showing a construction of a decoder according another embodiment of the present invention. In FIG. 11, the decoder is similar in construction to the decoder shown in FIG. 7 except that the backward linear prediction coefficients b are calculated from the reproduced excitation signal; The same constructive components as those in FIG. 7 are depicted by the same reference numerals, and the operations of those constructive components are similar.

That is, in the decoder shown in FIG. 11, the backward analyzer 23 of the decoder shown in FIG. 7 is replaced by a backward analyzer 31 for calculating the backward linear prediction coefficients from the reproduced excitation signal.

In the coder shown in FIG. 11, a signal input to the backward analyzer 31 is the reproduced excitation signal supplied not from the synthesizing filter 11, but the backward analyzer 31. Therefore, the backward analyzer 31 stores the reproduced excitation signal from the backward filter 10 in the past sub-frames and calculates the backward linear prediction coefficients b indicative of fine spectral distributions from the stored reproduced excitation signals.

Figure 12:
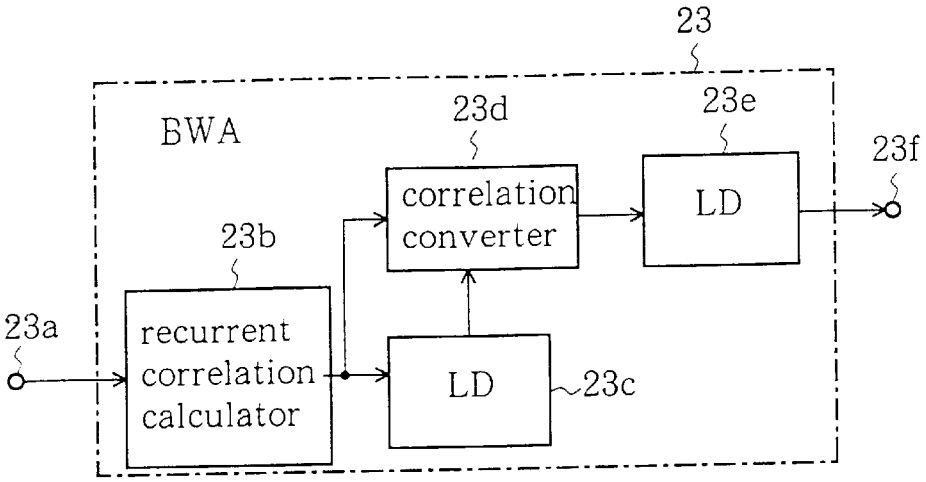
FIG. 12 is a block diagram showing a construction of the backward analyzer shown in each of FIGS. 4 to 7.

FIG. 12 is a block diagram showing a construction of the backward analyzer 23 used in the embodiments shown in FIGS. 4 to 7. In FIG. 12, the backward analyzer 23 is constructed with a recurrent correlation calculator 23*b*, Levinson Durbin circuits 23*c* and 23*e* and a correlation converter 23*d*.

The recurrent correlation calculator 23*b* recurrently calculates an auto-correlation signal from a signal input from an input terminal 23*a*. For performing the recurrent calculation, a method as disclosed in "A Fixed-Point 16 kb/s LD-CELP Algorithm", IEEE ICASSP'91, pp. 21–24, can be used.

In the method disclosed in the above article, the correlation calculation is performed by introducing a logarithmic function as the analysis window function such that the influence of the past signal is removed. That is, the auto-correlation in the current sub-frame is calculated by logarithmic weighted sum of a correlation component related to the input signal obtained in the current sub-frame to the auto-correlation value obtained in the past sub-frames. Therefore, it is possible to remove the correlation operation related to the past input signal and to substantially reduce the amount of arithmetic operation. The Levinson Durbin circuit 23*c* calculates flattening linear prediction coefficients to be used in the spectrum flattening by the LD method. etc., using a lower order correlation value among the correlation values calculated in the recurrent correlation calculator 23*b*.

The correlation converter 23*d* calculates a correlation value of the reproduced signal having a flattened spectrum by using the correlation value and the flattening linear prediction coefficients. The flattening calculation is performed by the following equation:

$$r(n) = d(n) + \sum_{i=1}^{Q}\sum_{j=1}^{Q} a(i)a(j)d(n+i-j) + \sum_{i=1}^{Q} a(i)d(n+i) + \sum_{j=1}^{Q} a(j)d(n-j)$$

where d(n) (n=0 to P) is the auto-correlation value before flattening processing, r(n) (n=0 to P) is the auto-correlation after the flattening, a(i) (i=1 to Q) is the linear prediction coefficient used in the flattening processing, and P and Q are the degrees of the flattening linear prediction filter and the backward linear prediction filter, respectively.

The Levinson Durbin circuit 23*e* calculates the backward linear prediction coefficients b by the above mentioned LD method, etc., using the auto-correlation value flattened by the correlation converter 23*d* and outputs then to an output terminal 23*f*.

Figure 13:
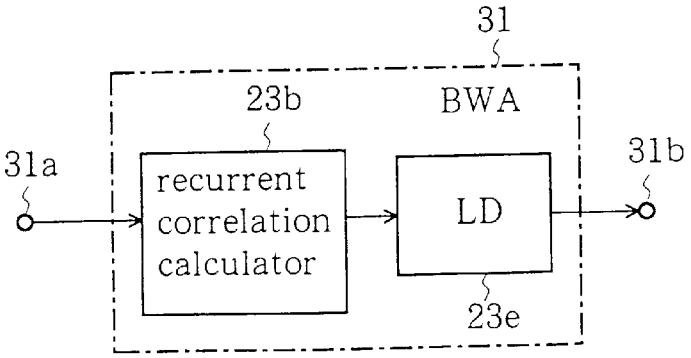
FIG. 13 is a block diagram showing a construction of the backward analyzer shown in each of FIGS. 8 to 11.

FIG. 13 is a block diagram showing a construction of the backward analyzer 31 used in the embodiments shown in FIGS. 8 to 11. In FIG. 13, the backward analyzer 31 is constructed with the recurrent correlation calculator 23*b* and the Levinson Durbin circuit 23*e*.

The recurrent correlation calculator 23*b* recurrently calculates the auto-correlation value from a signal input from an input terminal 31*a*. The Levinson Durbin circuit 23*e* calculates the backward linear prediction coefficients b from the auto-correlation value by the above mentioned LD method, etc., and outputs them to an output terminal 31*b*.

Incidentally, in the embodiments described, it is possible to use either one or both of the backward linear prediction filter and the pitch linear prediction filter depending upon the nature of the input signal. By this switching of the filter, it is possible to reduce the average amount of arithmetic operations.

This switching of the filter may be performed between a vowel portion and a consonant portion, as disclosed in "M-LCELP Speech Coding at 4 kb/s with Multi-Mode and Multi-Code book", IEICE Trans. Commun., Vol. E77-B, No. 9, September 1994. Since it is considered that the effect of prediction in the consonant portion may be small, it is possible to use neither the backward linear prediction filter nor the pitch linear prediction filter in the consonant portion.

Further, although in the described embodiments, the gain values of the code vector and the pitch vector are coded by two dimensional vectors, the gain quantization is simplified by coding these gain values independently, so that it is possible to reduce the amount of arithmetic operation.

Further, although in the embodiments mentioned above, the first order pitch prediction filter is used, it is possible to improve the performance by using a second or higher pitch prediction filter. Further, although the excitation signal is represented by a single stage code vector, it is possible to not only reduce the amount of arithmetic operation but to also improve the anti-transmission error characteristics by representing the excitation signal by with a multi-stage code vector.

As described above, it is possible to improve the coding performance with respect to the speech signal and the musical sound signal by coding them using the pitch linear prediction coefficients based on the production model representing the pitch periodic structure of the speech signal.

Further, it is possible to reduce the amount of arithmetic operation compared with the conventional coder and decoder, by calculating the backward linear prediction coefficients b using only the correlation value calculated from the reproduced signal and the flattening linear prediction coefficients or using the correlation value calculated from the reproduced excitation signal.

As described herein b according to the present invention, it is possible to code the speech signal and the musical sound signal with high performance and with a minimum amount of arithmetic operation by using the coder and decoder system comprising first filter means for representing an input signal with first linear prediction coefficients indicative of a coarse spectral distribution of the speech and musical sound signal, second filter means for representing the input signal with third linear prediction coefficients indicative of a periodic component of the input signal and third means connected in series with or in parallel to the second linear prediction filter for representing the input signal with third linear prediction coefficients indicative of a periodic component of the input signal, and by coding and decoding the input signal on the basis of parameters of the input signal produced on the basis of the residual signal between the reproduced signal obtained through the first, second and third filter means and the input signal.

What is claimed is:

1. A coding and decoding system for a speech sound signal and a musical sound signal, comprising:

a first filter for representing an input signal with first linear prediction coefficients indicative of a coarse spectral distribution of the input signal;

a second filter for representing the input signal with second linear prediction coefficients indicative of a fine spectral distribution of the input signal; and a third filter connected in series with or parallel to said second filter for representing the input signal with third linear prediction coefficients indicative of a periodic component of the input signal, wherein the second linear prediction filter coefficients are calculated using a residual signal between the input signal and a reproduced signal obtained through said first, second and third filters.

2. A coding and decoding system as claimed in claim 1, further comprising:

means for calculating a first correlation value from the reproduced signal quantized in the past or a reproduced excitation signal obtained through said second and third filters;

means for converting the first correlation value to flatten a coarse spectral distribution of the first correlation value;

and means for calculating the second linear prediction coefficients by using a second correlation value obtained by flattening the coarse spectral distribution.

3. A coding and decoding system as claimed in claim 2, wherein the coarse spectral distribution of the first correlation value is flattened using lower-order linear prediction coefficients calculated using the residual signal.

4. A coding and decoding system as claimed in claim 1, further comprising:

means for calculating a correlation value from a reproduced signal obtained through said second and third filters and quantized in the past; and means for calculating the second linear prediction coefficients by using the correlation value.

5. A coder for coding a speech and musical sound signal, comprising:

first filter means for producing a reproduced speech and musical sound excitation signal with first linear prediction coefficients indicative of a coarse spectral distribution of the speech and musical sound signal;

second filter means for producing the reproduced excitation signal of the speech and musical sound signal with second linear prediction coefficients indicative of a fine spectral distribution of the speech and musical sound signal;

third filter means for producing the reproduced excitation signal corresponding to the speech and musical sound signal by using only third linear prediction coefficients indicative of a periodic component of the speech and musical sound signal or using the third linear prediction coefficients and the second linear prediction coefficients; and means for producing parameters of the speech and musical sound signal produced on the basis of a residual signal between the speech and musical sound signal and the reproduced signal obtained through said first, second and third filter means, wherein the second linear prediction coefficients are calculated using the residual signal between the input signal and the reproduced signal obtained through said first, second and third filter means.

6. A coding and decoding system as claimed in claim 5, further comprising:

means for calculating a first correlation value from a reproduced signal quantized in the past or a reproduced excitation signal obtained through said second and third filter means;

means for converting the first correlation value to flatten the coarse spectral distribution of the first correlation value; and means for calculating the second linear prediction coefficients by using a second correlation value obtained by flattening the coarse spectral distribution.

7. A coding and decoding system as claimed in claim 6, wherein the coarse spectral distribution of the first correlation value is flattened using lower-order linear prediction coefficients calculated using the residual signal.

8. A coding and decoding system as claimed in claim 5, further comprising:

means for calculating a correlation value from the reproduced excitation signal obtained through said second and third filter means and quantized in the past; and means for calculating the second linear prediction coefficients by using the correlation value.

9. A decoder for decoding a speech and musical sound signal, comprising:

first filter means for producing a reproduced speech and musical sound signal corresponding to an input speech and musical sound signal by using only first linear prediction coefficients indicative of a periodic component of the speech and musical sound signal or using second linear prediction coefficients indicative of a fine spectral distribution of the speech and musical sound signal and the first linear prediction coefficients, on the basis of parameters of the input speech and musical sound signal;

second filter means for producing the reproduced excitation signal of the speech and musical sound signal by using the second linear prediction coefficients; and third filter means for producing the reproduced speech and musical sound signal by using third linear prediction coefficients indicative of coarse spectral distribution of the input speech and musical sound signal, wherein the second linear prediction coefficients are calculated using the residual signal between the input signal and the reproduced signal obtained through said first, second and third filter means.

10. A decoder as claimed in claim 9, further comprising:

means for calculating a first correlation value from a reproduced signal quantized in the past or a reproduced excitation signal obtained through said first and second filter means;

means for converting the first correlation value to flatten the coarse spectral distribution of the first correlation value; and means for calculating the second linear prediction coefficients by using a second correlation value obtained by flattening the coarse spectral distribution.

11. A coding and decoding system as claimed in claim 10, wherein the coarse spectral distribution of the first correlation value is flattened using lower-order linear prediction coefficients calculated using the residual signal.

12. A decoder as claimed in claim 9, further comprising:

means for calculating a correlation value from the reproduced excitation signal obtained through said first and second filter means and quantized in the past; and means for calculating the second linear prediction coefficients by using the correlation value.

13. A coding and decoding system for coding and decoding a speech and musical sound signal, comprising:

a coder comprising:

first filter means for producing a reproduced speech and musical sound signal with first linear prediction coefficients indicative of a coarse spectral distribution of the speech and musical sound signal;

second filter means for producing the reproduced excitation signal of the speech and musical sound signal with second linear prediction coefficients indicative of a fine spectral distribution of the speech and musical sound signal;

third filter means for producing the reproduced excitation signal corresponding to the speech and musical sound signal by using only third linear prediction coefficients indicative of a periodic component of the speech and musical sound signal or using the third linear prediction coefficients and the second linear prediction coefficients; and means for producing parameters of the speech and musical sound signal produced on the basis of a residual signal between the speech and musical sound signal and a reproduced signal obtained through said first, second and third filter means, wherein the second linear prediction coefficients are calculated using the residual signal between the input signal and the reproduced signal obtained through said first, second and third filter means; and a decoder comprising:

fourth filter means for producing the reproduced excitation signal corresponding to the speech and musical sound signal by using only the third linear prediction coefficients or using the second linear prediction coefficients and the third linear prediction coefficients, on the basis of parameters of the input speech and musical sound signal;

fifth filter means for producing the reproduced excitation signal of the speech and musical sound signal by using the second linear prediction coefficients; and sixth filter means for producing the reproduced speech and musical sound signal of the speech and musical sound signal by using the first linear prediction coefficients.

14. A coding and decoding system as claimed in claim 13, wherein said coder further comprises:

means for calculating a first correlation value from a reproduced signal quantized in the past or a reproduced excitation signal obtained through said second and third filter means;

means for converting the first correlation value to flatten the coarse spectral distribution of the first correlation value; and means for calculating the second linear prediction coefficients by using a second correlation value obtained by flattening the coarse spectral distribution.

15. A coding and decoding system as claimed in claim 14, wherein the coarse spectral distribution of the first correlation value is flattened using lower-order linear prediction coefficients calculated using the residual signal.

16. A coding and decoding system as claimed in claim 13, wherein said coder further comprises:

means for calculating a correlation value from the reproduced excitation signal obtained through said second and third filter means and quantized in the past; and means for calculating the second linear prediction coefficients by using the correlation value.

17. A coding and decoding system as claimed in claim 13, wherein said decoder further comprises:

means for calculating a third correlation value from one of a reproduced signal quantized in the past and the reproduced excitation signal obtained through said fourth and fifth filter means;

means for converting the third correlation value to flatten the coarse spectral distribution of the third correlation value; and means for calculating the second linear prediction coefficients by using a fourth correlation value obtained by flattening the coarse spectral distribution.

18. A coding and decoding system as claimed in claim 17, wherein the coarse spectral distribution of the third correlation value is flattened using lower-order linear prediction coefficients calculated using the residual signal.

19. A coding and decoding system as claimed in claim 13, wherein said decoder further comprises:

means for calculating a correlation value from the reproduced excitation signal obtained through said fourth and fifth filter means and quantized in the past; and means for calculating the second linear prediction coefficients by using the correlation value.

* * * * *